US009447702B2

(12) United States Patent
Mohan

(10) Patent No.: US 9,447,702 B2
(45) Date of Patent: Sep. 20, 2016

(54) COOLING SYSTEM AND COOLING METHOD FOR USE WITH CLOSED LOOP SYSTEMS

(71) Applicant: Sankar K. Mohan, Jamesville, NY (US)

(72) Inventor: Sankar K. Mohan, Jamesville, NY (US)

( * ) Notice: Subject to any disclaimer, the term of this patent is extended or adjusted under 35 U.S.C. 154(b) by 167 days.

(21) Appl. No.: 14/310,760

(22) Filed: Jun. 20, 2014

(65) Prior Publication Data

US 2014/0373544 A1 Dec. 25, 2014

Related U.S. Application Data

(60) Provisional application No. 61/837,973, filed on Jun. 21, 2013.

(51) Int. Cl.

| | |
|---|---|
| ***F01K 23/06*** | (2006.01) |
| ***F01K 9/00*** | (2006.01) |
| ***F01K 7/16*** | (2006.01) |

(52) U.S. Cl.

CPC *F01K 9/003* (2013.01); *F01K 7/16* (2013.01)

(58) Field of Classification Search

None

See application file for complete search history.

(56) References Cited

U.S. PATENT DOCUMENTS

| | | | | |
|---|---|---|---|---|
| 3,686,867 | A * | 8/1972 | Hull | F04F 5/54 60/667 |
| 4,262,485 | A * | 4/1981 | Kuroda | F01K 27/02 165/104.13 |
| 4,342,200 | A | 8/1982 | Lowi, Jr. | |
| 4,439,988 | A * | 4/1984 | Minardi | F01K 25/06 60/649 |
| 4,753,079 | A * | 6/1988 | Sumitomo | F01K 25/106 122/32 |
| 5,137,681 | A * | 8/1992 | Dougherty | G21D 5/06 376/211 |
| 5,287,694 | A * | 2/1994 | Davis | B64D 13/06 417/77 |
| 6,138,456 | A * | 10/2000 | Garris | C09K 5/041 417/178 |
| 6,550,253 | B2 | 4/2003 | Mortzheim et al. | |
| 6,668,553 | B1 | 12/2003 | Ghizawi | |
| 7,143,573 | B2 | 12/2006 | Hoffmann et al. | |
| 7,162,876 | B2 | 1/2007 | Hoff et al. | |
| 7,823,390 | B2 | 11/2010 | Eluripati et al. | |
| 8,240,153 | B2 | 8/2012 | Childers et al. | |
| 8,302,407 | B2 | 11/2012 | Alecu et al. | |
| 8,875,515 | B2 * | 11/2014 | Ast | F01K 13/00 60/645 |
| 2012/0210713 | A1 | 8/2012 | Ernst et al. | |
| 2014/0110939 | A1 * | 4/2014 | Takahashi | F01K 9/003 290/7 |
| 2014/0137554 | A1 * | 5/2014 | Ernst | F02G 5/04 60/615 |
| 2015/0145256 | A1 * | 5/2015 | Omoruyi | F01D 15/10 290/52 |

FOREIGN PATENT DOCUMENTS

| | | |
|---|---|---|
| GB | 856071 | 12/1960 |

* cited by examiner

*Primary Examiner* — Jesse Bogue

(74) *Attorney, Agent, or Firm* — Paul Frank + Collins P.C.

(57) ABSTRACT

Embodiments of systems that are configured as a closed loop system with a pump, an evaporator, a power generator, and a condenser, the combination of which circulates a working fluid to generate electrical power. The embodiments are configured with a cooling system that can depress the local pressure at or near components that are the target of cooling, which in turn permits the cooling fluid to function at temperatures that can remove heat, even when the ambient temperature rises above desirable levels. In one embodiment, the system is configured with an ejector device that can use energy of the working fluid F in vapor phase to lower the pressure in a housing, or like environment, that encloses critical elements of the generator.

19 Claims, 6 Drawing Sheets

COOLING SYSTEM AND COOLING METHOD FOR USE WITH CLOSED LOOP SYSTEMS

CROSS-REFERENCE TO RELATED APPLICATIONS

This application claims the benefit of priority to U.S. Provisional Patent Application Ser. No. 61/837,973, filed on Jun. 21, 2013, and entitled "COOLING SYSTEM AND COOLING METHOD FOR USE WITH CLOSED LOOP SYSTEMS." The content of this provisional application is incorporated herein by reference in its entirety.

BACKGROUND

The present disclosure describes subject matter that relates to closed loop systems, with particular discussion about embodiments of systems that are configured with a cooling system that utilizes a working fluid to evacuate and cool components.

Systems that generate power include closed loop systems that operate under principles of a Rankine Thermodynamic Cycle. These systems use thermal energy from a thermal source fluid to evaporate a working fluid, e.g., a low temperature boiling organic fluid. This process generates high pressure vapor. In conventional designs, the system directs the vapor to power generating machinery, for example, a turbine or like device, that can operate a generator to generate electric power. The system can also cool and condense the vapor to liquid form.

FIG. 1 illustrates a schematic diagram of an example of a conventional closed loop system 100. This embodiment includes a pump component 102, an evaporator component 104 (that utilizes a source fluid S), a power generating component 106, and a condenser component 108 (that utilizes a cooling medium C). The system 100 also includes a fluid circuit 110, typically a construction of fluid conduits (e.g., pipes, tubes, valves, etc.) that couple the components 102, 104, 106, 108 together. The fluid circuit 110 allows a working fluid F to circulate among the components 102, 104, 106, 108. In the example of FIG. 1, the working fluid F exhibits one or more set of working properties (e.g., a first set 112, a second set 114, a third set 116, and a fourth set 118), each set being configured to identify, for example, a pressure and a temperature of the working fluid F that circulates through the fluid circuit 110. The value of the working properties often correspond to phases (e.g., liquid, vapor, etc.) of the working fluid F. As also shown in FIG. 1, the fluid circuit 110 may include a cooling circuit 120 that directs working fluid F to the power generating component 106. The flow of the working fluid F in the cooling circuit 120 distributes the working fluid F as a cooling fluid with working properties to remove heat from certain components including, for example, elements (e.g., motor(s), electronics, etc.) of a generator.

The temperature of the cooling fluid in the cooling circuit 120 is related to the saturation temperature of the working fluid F at the pressure at which the working fluid F is allowed to expand. In closed loop systems like the system 100 of FIG. 1, the lowest pressure of the working fluid F is at the outlet of the condenser component 108. This pressure is roughly related to ambient temperature, e.g., of the environment surrounding the system 100. Unfortunately, an increase in ambient temperature can cause an increase in both the temperature of the working fluid F at the outlet of the condenser component 108 and the corresponding saturation pressure. This rise in temperature of the working fluid F also increases the temperature of the cooling fluid in the cooling circuit 120, which may in turn render the cooling fluid insufficient to cool elements and critical components to safe operating temperatures. As a result, designers may need to de-rate the system and/or power generating machinery based on the cooling effect alone to reflect a lower output during operations at operating conditions with higher ambient temperatures.

BRIEF DESCRIPTION OF THE INVENTION

The present disclosure contemplates improvements that facilitate cooling of components in closed loop systems. Embodiments of the systems below, for example, are configured to depress the local pressure at or near components that are the target of cooling, which in turn permits the cooling fluid to function at temperatures that can remove heat, even when the ambient temperature rises above desirable levels. In one embodiment, the system is configured to use energy of the working fluid F in vapor phase to lower the pressure in a housing, or like environment, that encloses critical elements of the generator. Notably, by utilizing the working fluid F in vapor phase, this configuration forgoes use of devices (e.g., pumps) with external power requirements that, in effect, would operate more as a parasitic loss or load and would likely reduce the overall efficiency of the system.

BRIEF DESCRIPTION OF THE DRAWINGS

Reference is now made briefly to the accompanying drawings in which.

Where applicable like reference characters designate identical or corresponding components and units throughout the several views, which are not to scale unless otherwise indicated.

DETAILED DISCUSSION

Figure 1:
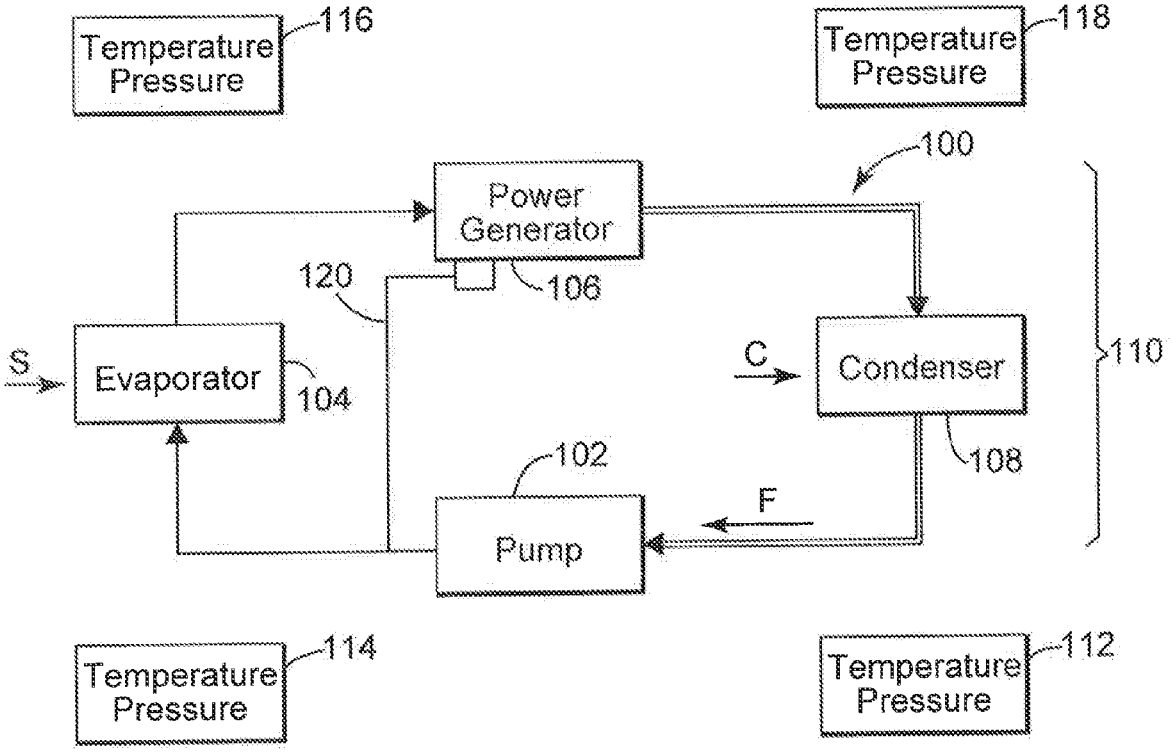
Fig. 1 Prior Art
FIG. 1 depicts a schematic diagram of an exemplary embodiment of a conventional closed loop system.
Figure 2:
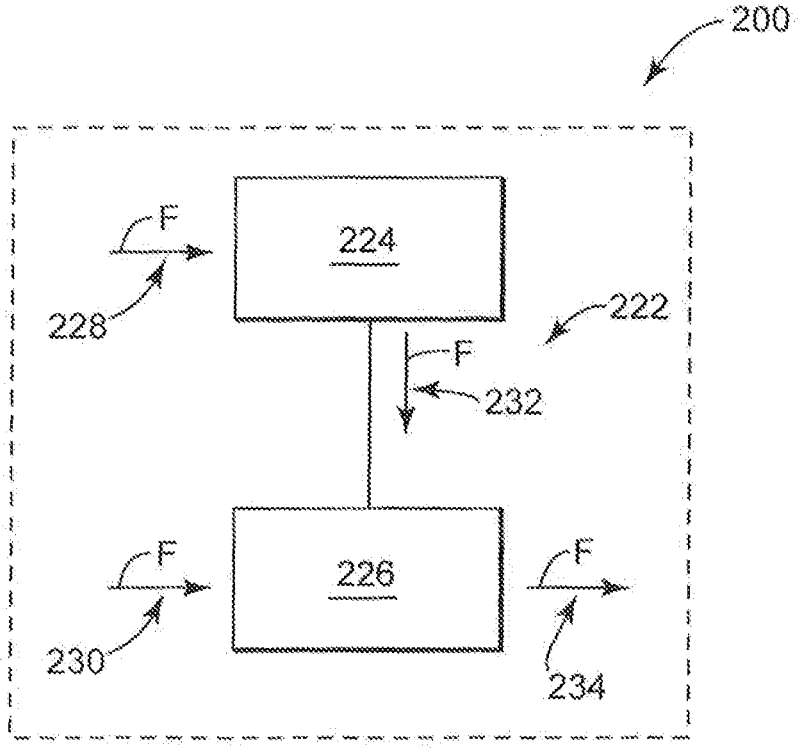
FIG. 2 depicts a schematic diagram of an example of a cooling system that can cool components of a closed loop system.

FIG. 2 illustrates a schematic diagram of an exemplary embodiment of a system 200 that is configured to maintain temperature of a cooling fluid. The system 200 includes a cooling system 222 with a sealed component 224 and an entrainment component 226. The components 224, 226 can integrate into the closed loop system 200. Examples of the cooling system 222 can direct a working fluid F throughout various components coupled and/or integrated therein. The working fluid F can comprise one or more fluid components (e.g., a first fluid component 228, a second fluid component 230, a third fluid component 232, and a fourth fluid component 234). The fluid components 228, 230, 232, 234 can exhibit certain fluid properties (e.g., pressure, temperature, etc.) and, in one example, the value of the fluid properties are different across the fluid components 228, 230, 232, 236. As shown in the diagram of FIG. 2, the first fluid component 228 and the second fluid component 230 enter, respectively, the sealed component 224 and the entrainment component 226. The third fluid component 232 and the fourth fluid component 234 exit, respectively, the sealed component 224 and the entrainment component 226.

Broadly, the entrainment component 226 include devices that use the energy of a motive fluid to create a low pressure zone or area. These devices include, for example, ejectors and/or injectors (and/or other devices that utilizes similar principles of operation to utilize the energy of one fluid to create a vacuum). In the present example, the cooling system 220 couples the low pressure zone of the entrainment component 226 with the sealed component 224. This configuration draws fluid from the sealed component 224 (e.g., the third fluid component 232). The fluid enters the entrainment component 226, where the fluid mixes with the second fluid component 230 and exits the entrainment component 226 as the fourth fluid component 234.

The sealed component 224 may house electrical and/or power components that generate heat and/or need to be cooled. These components may operate as part of power generating machinery (e.g., a turbine-generator), which integrates into the closed loop system 200. Examples of the power generating machinery may include turbines, which utilize the working fluid F that flows in the closed loop system 200 to generate power and/or electricity. This disclosure contemplates a wide variety of devices, components, and/or systems for use as the power generating component, e.g., devices that utilize impellers, screws, vanes, pistons, and other implements to transform the work of the flow of the working fluid F into power. Moreover, this disclosure recognizes that concepts of the cooling system 222 may extend to other variations of the closed loop system 200.

Figure 3:
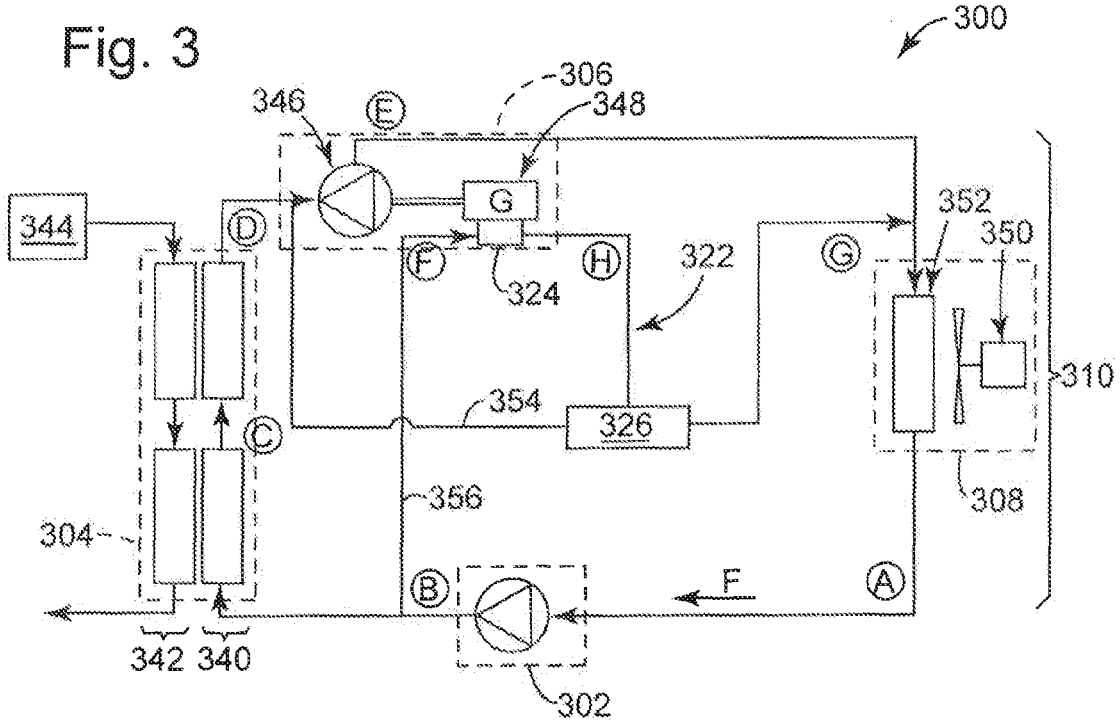
FIG. 3 depicts a schematic diagram of an exemplary embodiment of a closed loop system that includes an example of a cooling system for cooling components, e.g., of a generator.
Figure 4:
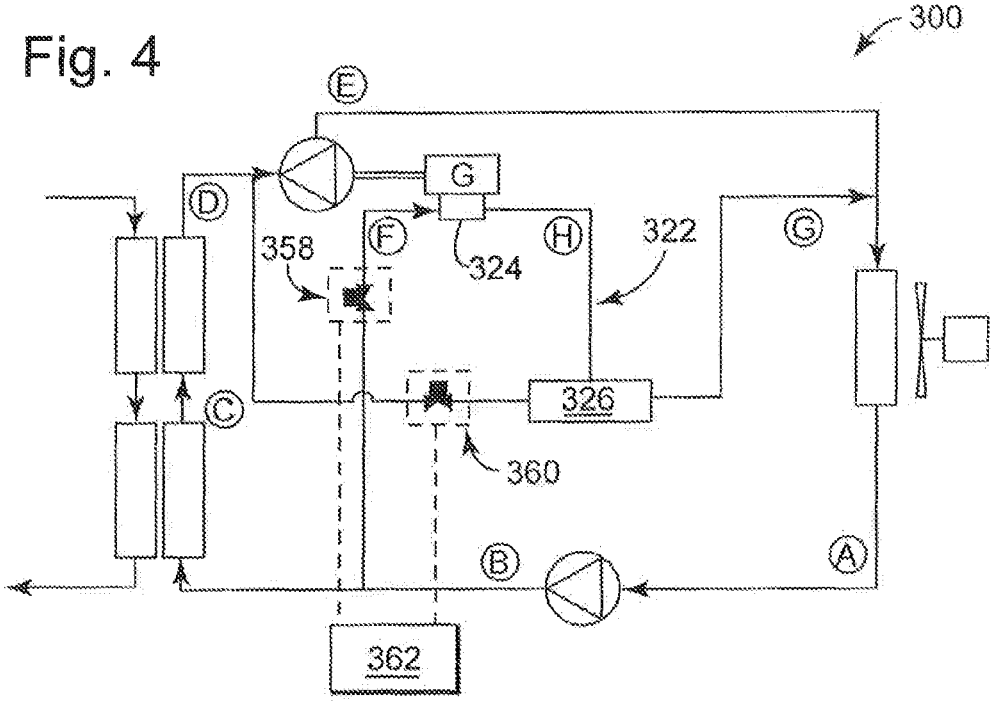
FIG. 4 depicts the closed loop system of FIG. 3 with a control system that can regulate flow of fluid in the cooling system.

FIGS. 3 and 4 depict a schematic diagram of an exemplary construction for a closed loop system 300 that can utilize the working fluid to cool components. In the embodiment of FIG. 3, the evaporator component 304 can include a heated member 336 and an evaporator member 338, each having a circuit portion 340 and a heated portion 342 that couples with a heat source 344. The power generating component 306 has a turbine member 346 that couples with a generator member 348. The combination of the components 346, 348 can generate electric power during operation of the system 300. The condenser component 308 can include a fan member 350 that operates to cool a condenser member 352. As also shown in FIG. 3, the cooling system 322 includes one or more flow paths (e.g., a first flow path 354 and a second flow path 356).

The flow paths 354, 356 are configured to direct working fluid F from the fluid circuit 310, in both liquid phase and vapor phase. In the present example, the first flow path 354 can couple with the fluid circuit 310 at a first point downstream of the evaporator component 302 and upstream of the turbine member 346 and at a second point upstream of the condenser member 352 and downstream of the turbine member 346. This configuration of the cooling system 322 can distribute working fluid F in vapor phase (from the first point of the fluid circuit 310) to the entrainment component 326, as well as to allow fluid from the entrainment component 326 to reenter the fluid circuit 310 (at the second point). The second flow path 356 can couple with the fluid circuit 310 at a point shown in FIG. 3 as downstream of the pump component 302. This configuration can direct the working fluid F in liquid phase (as the cooling fluid) to the sealed component 324. The second flow path 354 can also couple the sealed component 324 with the entrainment component 326 to allow the cooling fluid to enter the entrainment component 326.

During operation, the system 300 leverages changes in the working properties and phases of the working fluid F to convert thermal energy to mechanical and/or electrical energy. Starting in the lower right corner of FIG. 3, and working clock-wise around the system 300, the working fluid F enters the pump component 302 at a first pressure (e.g., 2 bar) and a first temperature (e.g., 40° C.). The pump component 302 changes the first pressure to a second pressure (e.g., 20 bar) that is different (e.g., greater) than the first pressure. The evaporator component 304 is configured to modify the temperature of the working fluid F from the first temperature to a second temperature (e.g., 125° C.) that is different (e.g., greater) than the first temperature. The power generating component 306 extracts useful work (e.g., to turn a turbine) from the working fluid F, which in turn changes the temperature of the working fluid F from the second temperature to a third temperature (e.g., 80° C.) that is different (e.g., less) than the second temperature and changes the second pressure to a third pressure (e.g., 2 bar) that is different (e.g., less) than the second pressure. From there, the condenser component 308 is configured to modify the temperature and pressure of the working fluid F, typically back to the first temperature and the first pressure.

The cooling system 322 utilizes a portion of the working fluid F as the cooling fluid to cool components, namely, electronic components found in the sealed component 324. This cooling fluid may, for example, correspond with the high pressure working fluid F (e.g., 20 bar, 40° C.) that exits the pump component 302. In one implementation, the cooling fluid enters the sealed component 324, passes over the electronic components, and expands to the condenser pressure (e.g., 2 bar). To lower the cooling temperature of the cooling fluid, the entrainment component 326 is configured to evacuate the sealed component 324. In one example, the entrainment component 326 is configured as an ejector (and/or an injector) to utilize energy in a small portion of incoming working fluid F in vapor phase (e.g., 20 bar, 125° C.) that exits the evaporator component 304. This incoming working fluid vapor F provides motive power to evacuate the sealed component 324.

Use of the entrainment component 326 can modify operating conditions inside of the sealed component 326. In one implementation, the entrainment component 326 can create a pressure inside of the sealed component 324 that is lower than the condensing pressure. This operating condition, in turn, can overcome thermodynamic limits on the lower bound of the temperature that can be reached because the saturation temperature (e.g., 33.5° C.) corresponds to the condensing pressure. Moreover, since use of thermal energy in the working fluid F is less expensive than, for example, electrical energy that might be required to operate a vacuum pump or similarly configured device, the cooling system 322 can improve the overall efficiency and can expand the operating range of the cooling system 300. This configuration is also beneficial because it can minimize the need to de-rate the system 300 at higher ambient temperatures, there is no contamination or leakage because the system 300 is self-contained, and because there are no moving parts that may compromise reliability and safety.

As best shown in FIG. 4, the cooling system 322 may also include one or more control components (e.g., a first control component 358 and a second control component 360) that couple with a control unit 362. Examples of the control components 358, 360 can include valves (e.g., control valves) and like devices that can regulate flow of the working fluid. The control unit 362 can be configured to manage the process of the system 300. This configuration may require use of one or more processors, memory, and related circuitry that can allow the control unit 362 to exchange signals, instructions, etc. with the various components of the system 300. In certain embodiments, the control unit 362 may utilize executable instruction or machine readable instructions (e.g., software, firmware, etc.) that the one or more processors are configured to execute in order to perform, e.g., processing and generating of signals. Example of the signals can cause the control components 358, 360 to open and close, to vary degrees where necessary, to modulate the flow of the working fluid F, both as the cooling fluid and the motive fluid, as desired.

Figure 5:
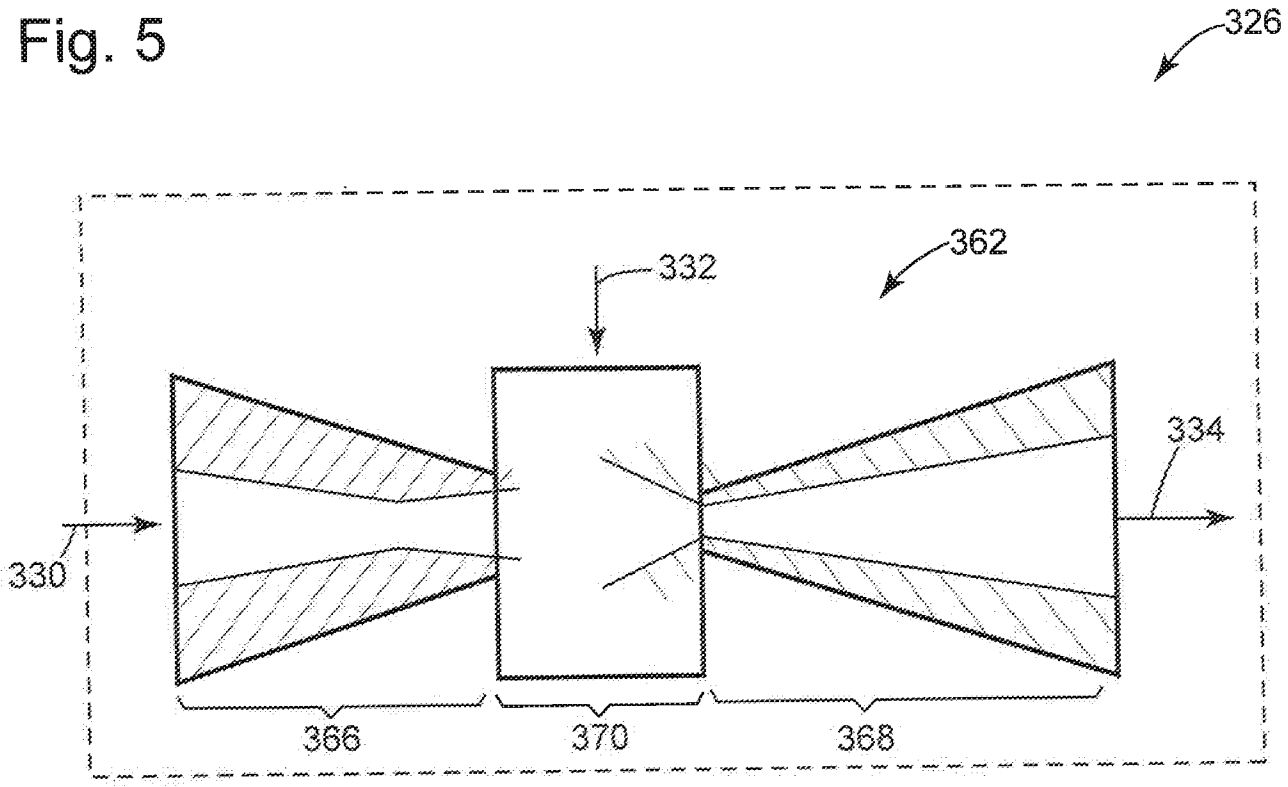
FIG. 5 depicts an example of an entrainment component for use in exemplary embodiments of a cooling system.

FIG. 5 illustrates an exemplary construction for an entrainment component 326 in the form of an ejector device 364. This construction includes a first nozzle section 366, a second nozzle section 368, and a mixing and entrainment zone 370 disposed therebetween. In one implementation, the second fluid component 330 flows through the first nozzle section 366, which in turn lowers the pressure in the mixing and entrainment zone 370. The low pressure draws the third fluid component 332 into the ejector device 362. The third fluid component 332 mixes with the second fluid component 330 and, in one example, the fluid mixture flows through the second nozzle section 368 to exit the ejector device 362 as the fourth fluid component 334.

The ejector device 364 is useful to evacuate the sealed component 324 (FIG. 3). In operation, the ejector device receives a small portion (also "flow") (e.g., −1%) of the high energy working fluid F (e.g., 20 bar, 125° C.). This portion is diverted to the nozzle section 366 (e.g., sub-sonic, sonic, or super-sonic). The enthalpy of the fluid is converted into kinetic energy in the nozzle. This configuration creates a low pressure zone (e.g., −1 bar) in the entrainment zone 370. During operation, cooling fluid (e.g., vapor) from the sealed component 324 (FIG. 3) enters this low pressure zone, thereby creating a corresponding expansion equivalent to a saturation temperature of about 15° C. The high velocity vapor entrains the low pressure cooling fluid, increasing the kinetic energy of the low pressure cooling fluid in the entrainment zone 370. The kinetic energy of the resulting mixture is recovered back into pressure energy (e.g., 2 bar) in the second nozzle section 334, which is coupled with the inlet to the condenser member 352 to allow the fluid mixture to flow back into the fluid circuit 310 (FIG. 3).

Figure 6:
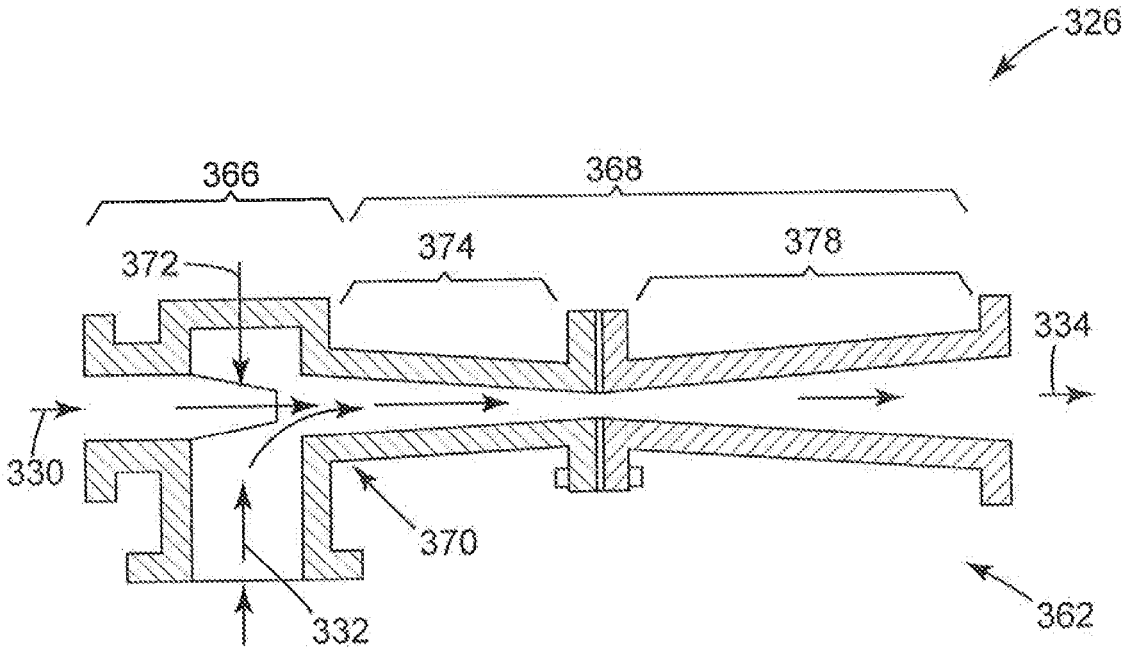
FIG. 6 depicts an example of an entrainment component for use in exemplary embodiments of a cooling system.
Figure 7:
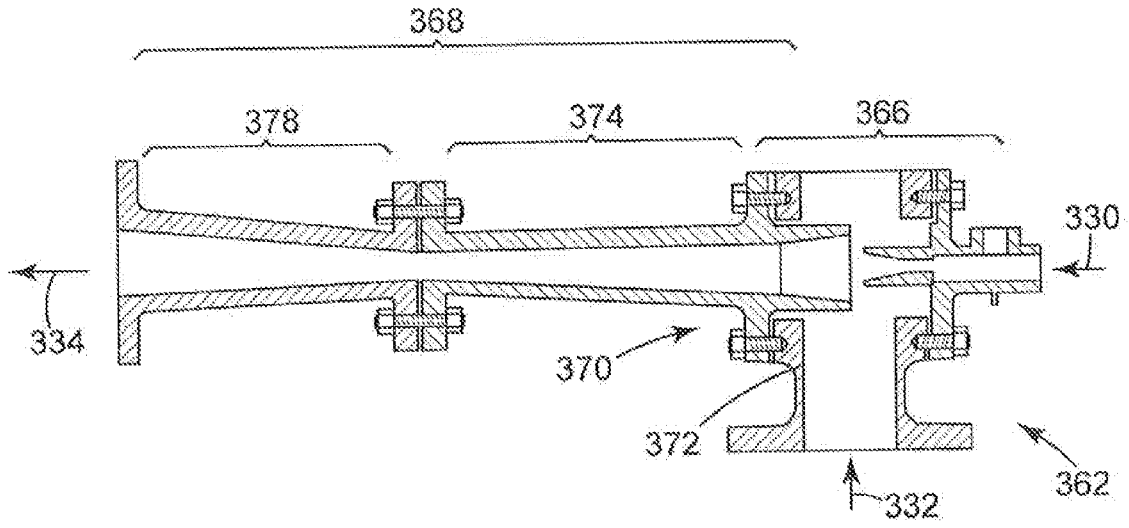
FIG. 7 depicts an example of an entrainment component for use in exemplary embodiments of a cooling system.

FIGS. 6 and 7 illustrates exemplary construction for the ejector device 362. In these examples, the first nozzle section 366 includes an inlet nozzle 372. The second nozzle section 368 includes a converging nozzle section 374 and a diverging nozzle section 378. Examples of the inlet nozzle 372 include various configurations, e.g., convergent (also "sub-sonic") configurations as shown in FIG. 6 and convergent/divergent (also "super-sonic") configurations as shown in FIG. 7.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for generating power, said system comprising:

a fluid circuit configured to circulate working fluid to a pump component, an evaporator component, a power generating component, and a condenser component, the power generating component comprising a housing;

an entrainment component coupled with the housing, the entrainment component configured to use energy of the working fluid to create a low pressure zone; and a flow path coupled with the entrainment component and with the fluid circuit, the flow path configured to direct effluent from the evaporator component out of the fluid circuit to provide the working fluid to operate the entrainment component, wherein the entrainment component is configured to evacuate the housing in response to flow of the working fluid.

2. The system of claim 1, wherein the entrainment component comprises an ejector device having a first nozzle section that modifies flow of the working fluid.

3. The system of claim 2, wherein the first nozzle section has a sub-sonic configuration.

4. The system of claim 2, wherein the first nozzle section has a super-sonic configuration.

5. The system of claim 2, wherein the entrainment component comprises a mixing zone that is configured to receive fluid from the housing and fluid from the first nozzle section.

6. The system of claim 1, wherein the flow path couples with the fluid circuit at a first point downstream of the evaporator component and upstream of the power generating component.

7. The system of claim 5, wherein the entrainment component couples with the fluid circuit downstream of the power generating component.

8. The system of claim 1, further comprising a second flow path coupled with the housing and with the fluid circuit, wherein the housing is configured to receive working fluid via the second flow path.

9. The system of claim 1, wherein the entrainment component is configured to lower pressure in the housing below a condensing pressure of the working fluid.

10. A system for generating power, said system comprising:

a fluid circuit configured to circulate a working fluid from an evaporator component to a power generating component;

a flow path coupled with the fluid circuit; and an entrainment component coupled with the flow path, the entrainment component configured to use energy of the working fluid to generate a low pressure zone in response to flow of the working fluid in vapor phase, wherein the flow path is configured to direct effluent from the evaporator component out of the fluid circuit to provide the working fluid to operate the entrainment component.

11. The system of claim 10, wherein the entrainment component comprises at least one nozzle section that modifies flow of the working fluid upstream of the low pressure zone.

12. The system of claim 10, wherein the entrainment component couples with the power generating component, and wherein the low pressure zone is configured to receive a cooling fluid from the power generating component.

13. The system of claim 10, wherein the entrainment component is configured to allow the working fluid and the cooling fluid to mix with one another to form a fluid mixture.

14. The system of claim 13, wherein the flow path is configured to allow the fluid mixture to flow back to the fluid circuit.

15. The system of claim 10, wherein the flow path couples with the fluid circuit upstream of the power generating component.

16. A closed loop system, comprising:

a fluid circuit that is configured to circulate a working fluid from an evaporator component to a power generating component having a turbine and a generator, the generator having a housing, a cooling system coupled with the housing, the cooling system configured to generate a low pressure zone, in response to flow of the working fluid in vapor phase, that configures the housing with a pressure that is lower than the condensing pressure of the working fluid; and a flow path coupled with the cooling system and with the fluid circuit, the flow path configured to direct effluent from the evaporator component out of the fluid circuit to provide the working fluid to operate the cooling system.

17. The cooling system of claim 16, wherein the cooling system comprises an ejector device with one or more nozzle sections configured to couple the ejector device with the flow path to receive the effluent from the evaporator component, wherein the one or more nozzle sections include a first nozzle section and a second nozzle section, one each disposed, respectively, upstream of the low pressure zone and downstream of the low pressure zone.

18. The cooling system of claim 17, wherein the second nozzle section comprises a converging nozzle section and a diverging nozzle section.

19. The cooling system of 17, wherein the ejector device has a mixing zone that is configured to allow working fluid in vapor phase and working fluid in liquid phase from the housing to mix with one another to form a fluid mixture, and wherein the one or more nozzle sections are configured to allow the fluid mixture to flow out of the ejector device.

* * * * *